US005085205A

United States Patent [19]

Hall et al.

[11] Patent Number: 5,085,205

[45] Date of Patent: Feb. 4, 1992

[54] FUEL-FIRED WATER HEATED WITH COMBINATION DRAINAGE PAN AND COMBUSTION AIR FLOW CONTROL APPARATUS

[75] Inventors: Jacob H. Hall, Montgomery; Timothy E. Powell, Tallassee, both of Ala.

[73] Assignee: Rheem Manufacturing Company, New York, N.Y.

[21] Appl. No.: 698,479

[22] Filed: May 9, 1991

[51] Int. Cl.[5] ..... F24H 1/00

[52] U.S. Cl. ..... 126/363; 126/350 R; 137/312; 122/504

[58] Field of Search ..... 126/344, 361, 363, 373, 126/350 R, 355, 359; 122/504, 507; 137/312

[56] References Cited

U.S. PATENT DOCUMENTS

| | | | |
|---|---|---|---|
| 957,375 | 5/1910 | Raser | 126/359 |
| 2,328,245 | 8/1943 | Yavitch | 126/363 |
| 3,473,553 | 10/1969 | Collins | 137/312 |
| 3,920,031 | 11/1975 | Maxfield | 137/67 |
| 4,765,360 | 8/1988 | Baird | 137/312 |
| 4,909,274 | 3/1990 | Rodriquez | 137/312 |
| 4,944,253 | 7/1990 | Bellofatto | 122/504 |

*Primary Examiner*—James C. Yeung
*Attorney, Agent, or Firm*—Johnson & Gibbs

[57] ABSTRACT

A fuel-fired water heater has a plurality of bottom end legs which hold the bottom end of the heater a few inches above the floor, and a fuel burner positioned directly above a combustion air inlet in the bottom end of the heater body. To assure that all combustion air delivered to the burner is taken from a height at least 18" above the floor, a bottom end portion of the water heater is positioned within a floor supported, horizontally enlarged drain pan which vertically extends to at least 18" above the floor. In one embodiment thereof, the drain pan has an open top through which combustion air enters and is drawn downwardly to the bottom air inlet of the heater, and in another embodiment the drain pan top is closed off and combustion air is ducted into the pan from a remote, higher location. The pan has an outlet fitting which may be connected to a pipe or hose to drain away any water leaking from the water heater, or from closely adjacent piping and/or fittings connected thereto.

15 Claims, 1 Drawing Sheet

FUEL-FIRED WATER HEATED WITH COMBINATION DRAINAGE PAN AND COMBUSTION AIR FLOW CONTROL APPARATUS

BACKGROUND OF THE INVENTION

The present invention relates generally to water heaters, and more particularly relates to the supply of combustion air to floor mountable, fuel-fired water heaters.

Floor mounted, fuel-fired domestic water heaters are typically of a cylindrical configuration with floor support legs depending from the bottom end of the heater. With the water heater in its normal operating position, the support legs engage the floor and support the water heater in a vertical position with the bottom end of the cylindrical heater structure spaced a few inches above the floor.

The elevated bottom end of the water heater typically has a suitable combustion air inlet formed therein directly beneath a fuel burner disposed within the interior of the water heater. Fuel (such as natural gas) is supplied to the burner via a fuel line in which a fuel valve is interposed, the fuel valve being mounted on an exterior side surface portion of the water heater. During operation of the water heater, fuel supplied to the burner is mixed with combustion air drawn upwardly through the heater's bottom end opening to form a fuel-air mixture which is burned and used to heat water held in an internal storage tank portion of the heater for periodic supply to a variety of hot-water using devices.

When the water heater is to be installed in an area in which flammable liquids (such as gasoline) are to be stored the water heater may be supported in an elevated relationship with the floor—by, for example, mounting the heater on a suitable pedestal structure—to maintain a minimum floor-to-burner vertical clearance distance of at least 18". Leg extension kits, and other heater elevating apparatus, may also be used to achieve this result.

The goal in maintaining this minimum floor-to-burner vertical clearance is to position the burner generally above the level of heavier-than-air flammable vapors which may have settled to the floor adjacent the water heater, to thereby materially lessen the possibility that the operating burner, or related pilot or ignition components of the heater, will ignite the fumes. The purpose in positioning the burner above an anticipated flammable vapor level can occasionally be defeated, however, by the combustion updraft created by burner operation. This updraft, which beneficially serves to draw combustion air upwardly to the burner through the bottom air inlet in the heater body, is sometimes strong enough to also draw adjacent flammable vapors upwardly into contact with the burner flame, the pilot flame, or related hot ignition apparatus. In such instances, of course, the positioning of the burner a substantial distance above the floor, even though in strict compliance with applicable safety codes is to no avail. This elevation thereof the water heater above the floor can also create vertical clearance problems when the water heater is to be installed in areas having low ceilings.

It can be readily be seen from the foregoing that it would be desirable to provide improved apparatus and methods for isolating the burner in a floor mounted, fuel fired water heater from flammable vapors adjacent the floor near the heater. It is accordingly an object of the present invention to provide such improved apparatus and methods.

SUMMARY OF THE INVENTION

In carrying out principles of the present invention, in accordance with a preferred embodiment thereof, combination drainage pan and combustion air flow control apparatus is provided for use with a fuel-fired, floor mountable water heater, and functions to (1) receive and drain away water leaking from the water heater or adjacent piping and fittings, and (2) assure that burner combustion air entering the water heater is supplied thereto from a height above the floor approximately equal to or somewhat greater than the requisite 18" above the floor.

A conventional gas fired water heater with which the combination drainage and air flow control means of the present invention may be utilized typically has a body with a lower end having depending leg means thereon for supporting the body on the floor in a vertical orientation in which the lower body end is a few inches above the floor. A combustion air inlet is formed in a lower body end portion.

A gas burner disposed within the body is positioned directly above the air inlet, and is operative to receive and combust a mixture of gas from a source thereof and combustion air flowing upwardly through the inlet opening. Gas is delivered to the burner via a gas valve mounted on an exterior side portion of the body. Flames from the burner are used to heat water, disposed in an interior storage tank portion of the water heater, for on-demand delivery to a hot water-using device. The combination drainage pan and combustion air flow control means of the present invention comprise a specially designed drain pan structure having a bottom wall positionable on the floor and upon which the water heater body leg means may be rested. A vertical side wall portion of the pan structure is sized and configured to outwardly circumscribe a lower end portion of the vertically oriented water heater body, with an upper end of the side wall portion being positioned above the level of the burner and at least 18" above the floor. Outlet means are connected to a lower end section of the vertical sidewall portion of the pan structure and are operative to drain away water leaking from the water heater, and/or its closely adjacent piping and fitting portions, received in the drain pan structure.

In one representative embodiment thereof, the drain pan structure has a cylindrical configuration and an open top end. With a lower end portion of the water heater body operatively inserted into and supported within the pan structure interior, the side wall portion of the pan structure outwardly circumscribes the gas valve and forms an annular, vertically extending combustion air flow passage around the lower end portion of the water heater body. Sealed access door means are preferably provided on the vertical side wall portion of the pan structure, directly in front of the gas valve, to permit selective access to the gas valve and other components such as the water heater drain valve, burner assembly, etc.

During operation of the water heater, combustion air is drawn into the open top end of the annular vertical flow passage within the pan structure, flows down the annular passage to beneath the elevated lower end of the water heater body, and is then drawn upwardly through the body air inlet to the burner. In this manner, all combustion air utilized by the burner originates at a location at least 18" above the floor, thereby substantially lessening the possibility that heavier-than-air flammable vapors adjacent the floor will be drawn into contact with the burner, or its related pilot and ignition apparatus, during water heater operation.

In another representative embodiment of the drain pan structure, its open top end is closed off by an annular top end closure plate structure which circumscribes the water heater body above the gas valve. An air inlet opening is formed in an upper end portion of the pan structure and is connectable to air supply conduit means for supplying combustion air from a source thereof to the interior of the drain pan structure. In this manner, combustion air from a remote source (such as, for example, an outdoor air intake louver) may be ducted to the water heater.

The drain pan structure of the present invention is quite simple to use, is relatively inexpensive to fabricate and install, and in a single structure provides the dual benefits of conveniently draining away water leaking from the water heater body, and/or its immediately adjacent piping and fitting portions, and maintaining the water heater combustion air source level at least 18" above the floor without having to appreciably elevate the water heater relative to the floor.

Additionally, the drain pan structure may be used in conjunction with other types of floor mountable, fuel-fired water heating appliances, such as boilers, if desired. Accordingly, as used herein, the term "water heater" is intended to encompass both domestic water heaters and these other types of fuel-fired appliances.

While the apparatus of the present invention is representatively illustrated as being used in conjunction with a water heater having a cylindrical, vertically elongated body configuration, it will be readily appreciated by those skilled in this art that it could also be utilized to advantage with fuel-fired water heaters having noncylindrical and/or non-vertically elongated body configurations. Moreover, while the apparatus is particularly useful in mounting a fuel-fired water heater on the floor of, for example, a garage or storage room, it could also be utilized in other equipment areas such as, for example, attics.

DETAILED DESCRIPTION

Figure 1:
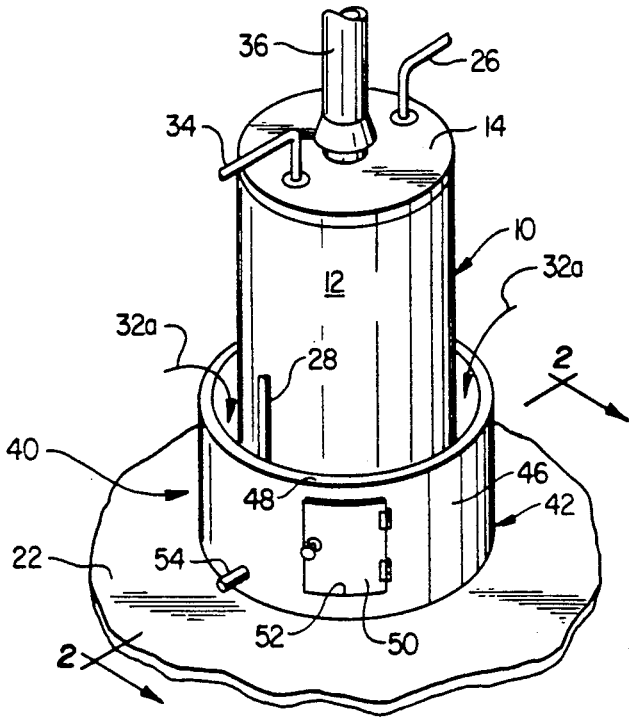
FIG. 1 is a somewhat simplified perspective view of a fuel-fired water heater provided with combination drainage pan and combustion air flow control apparatus embodying principles of the present invention.
Figure 2:
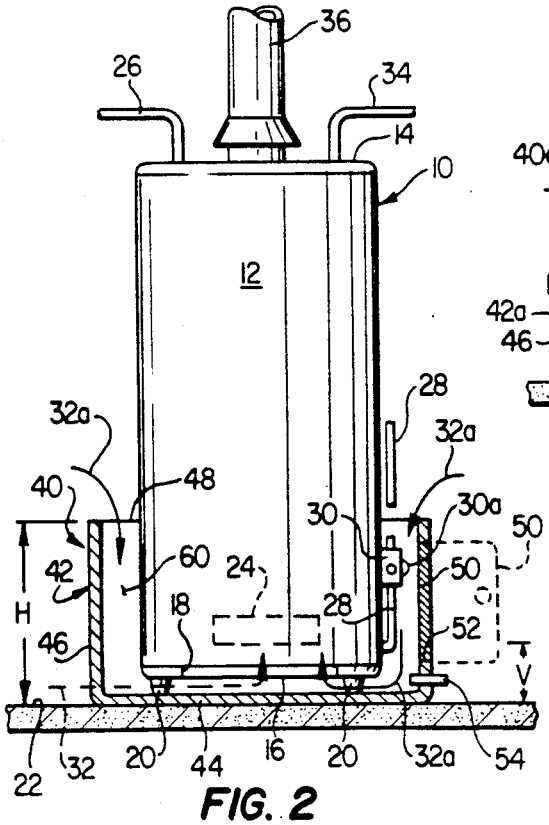
FIG. 2 is an enlarged scale, partially elevational cross-sectional view through the water heater and combination drainage pan and combustion air flow control apparatus taken along line 2—2 of FIG. 1.

Illustrated in FIGS. 1 and 2 is a conventional gas-fired water heater 10 having a vertically oriented, representatively cylindrical body portion 12 having a top end 14, and a bottom end 16 in which a combustion air inlet 18 is formed. A spaced apart plurality of support legs 20 depend from the bottom body end 16 and are adapted to engage a floor 22 and hold the bottom body end 16, and its associated inlet opening 18, a few inches above the floor 20.

A gas burner 24 (FIG. 2) is mounted within the body 12, although in some water heater designs it could be mounted externally on the body. The illustrated burner 24 is directly above and closely adjacent the air inlet 18 and is positioned beneath a hot water storage tank (not shown) which is mounted within the interior of the body 12 and is adapted to hold a quantity of water supplied to it through a cold water inlet pipe 26 extending through the top end 14 of the water heater body 12. A gas supply line 28 extends down an exterior side of the body 12, to adjacent the bottom end 16 thereof, and is connected to burner 24 to supply gas thereto.

Interposed in the gas supply line 28 is a gas control valve 30 which, under the control of an adjustable thermostat portion $30_a$ thereof, is operable to regulate the gas inflow to the burner 24. As is customary, the valve 30 is externally mounted on the water heater body 12 at a higher level than that of the burner 24.

During operation of the water heater 10, when it is supported directly on the floor 22, gas entering the burner 24 is mixed with combustion air 32, upwardly entering the inlet opening 18, to form a fuel-air mixture which is burned and used to heat the water disposed in the previously mentioned storage tank portion of the water heater 10. Upon demand, the heated water is supplied to one or more hot water-using devices via a hot water supply pipe 34 connected to the storage tank and extending outwardly through the top end 14 of the water heater body 12. Combustion gases generated by the operation of the burner 24 are vented from the water heater flue via a vent 36 operatively connected to the body 12.

In the representatively illustrated water heater 10, the support legs 20 are approximately 2" long, and the burner 24 is approximately 2" above the top ends of the legs. Accordingly, if the water heater was simply placed on the floor 22, the burner 24 would be positioned approximately 4" above the floor.

When a fuel-fired water heater of this type is to be located in an area (such as a garage) in which flammable liquids (such as gasoline) are stored the water heater may be positioned so that its burner is between at a minimum height "H" (typically at least 18") above the floor—usually by placing the water heater on a floor pedestal structure (not shown) sufficiently high to provide the minimum 18" floor-to-burner vertical clearance distance.

The goal in maintaining this minimum 18" floor-to-burner vertical clearance is to position the burner 24 generally above the level "V" of heavier-than-air flammable vapors which may have settled to the floor 22 adjacent the bottom end of the water heater body 12, to thereby materially lessen the possibility that the operating burner 24 (or its related pilot and/or ignition components) will ignite the flammable vapors. This 18" clearance distance is mandated in certain water heater locations (such as residential and commercial garages) by the National Fuel Gas Code.

The purpose in positioning the burner 24 above an anticipated flammable vapor level "V" is sometimes defeated, however, by the combustion updraft created by burner operation. This updraft, which beneficially serves to draw combustion air 32 upwardly to the burner 24 through the bottom inlet 18 in the water heater body 12, is occasionally strong enough to also draw adjacent flammable vapors upwardly into contact with the burner flame. In such instances, of course, the positioning of the burner 24 a substantial distance above the floor is to no avail.

The present invention substantially lessens the possibility that floor-disposed flammable vapors will be drawn upwardly into contact with the burner 24, or its related ignition and/or pilot components, during water heater operation via its unique provision of a specially designed combination drainage catch pan and combustion air flow control structure 40 which is usable in conjunction with the water heater 10 in a manner that will now be described in conjunction with FIGS. 1 and 2.

In the representatively illustrated preferred embodiment thereof, the structure 40 comprises a cylindrical drainage catch pan 42 having a circular bottom end wall 44 adapted to rest upon the floor 20 and having a diameter greater than the external diameter of the water heater body 12. Extending upwardly from around the periphery of the bottom pan end wall 44 is a circular side wall 46 having a height "H" equal to the requisite 18" floor-to-burner vertical clearance distance. As illustrated, the top edge of side wall 46 is substantially above the level of the burner 24. The pan 42 has a circular open upper end 48, and an access door 50 sealingly and pivotally mounted in a complementarily configured opening 50. As illustrated in FIGS. 1 and 2, the access door 50 is pivotable inwardly and outwardly, about a vertical axis, between a solid line closed and sealing position, and a dotted line open position.

The structure 40, in addition to being of an uncomplicated and quite inexpensive construction, is very easy to install and use. All that is required is to simply set the pan 42, open end up, on the floor 22, and connect a suitable drain pipe or hose (not shown) to a drainage outlet fitting 54 operatively connected to a bottom end portion of the pan 42 as illustrated. The water heater 10 is then lowered into a central portion of the pan 42 in a manner such that the support legs 20 come to rest on the bottom pan wall 44 and the gas valve is directly behind the access door 50. The vent, water pipe and gas line connections are then made to the water heater.

With the water heater 10 installed within the pan 42 as shown in FIGS. 1 and 2, an annular combustion air inlet passage 60 is defined between the water heater body 12 and the vertical pan side wall 46, the inlet passage opening outwardly from the pan at its top end 48. During operation of the water heater 10, all of the combustion air $32_a$ used by the burner 24 is caused to initially enter the inlet flow annulus 60 at the open top end 48 of the pan 42—i.e., at a height "H" substantially higher than the potential flammable vapor height "V".

Combustion air $32_a$ taken from this substantially increased height flows downwardly through the annulus 60, turns under the bottom end 16 of the water heater body 12, and is drawn upwardly to burner 24 via the bottom air inlet 18 in body 12. In this manner, the likelihood that flammable vapors, at height "V", will be drawn into contact with the operating burner 24 is substantially lessened.

As an added benefit, the pan 42 also serves to safely receive and drain away water (via the outlet fitting 54 and its associated drainage pipe or hose) which may be leaking from the internal storage tank portion of the water heater 10, thereby serving to protect the floor 22 (and surrounding floor areas) from potential flooding and water damage. The side wall door 50 permits easy access to the gas valve 30 for necessary repairs and adjustments of the valve, its associated thermostat portion 32, and other water heater components such as, for example, the water heater drain valve and the burner assembly.

Figure 2A:
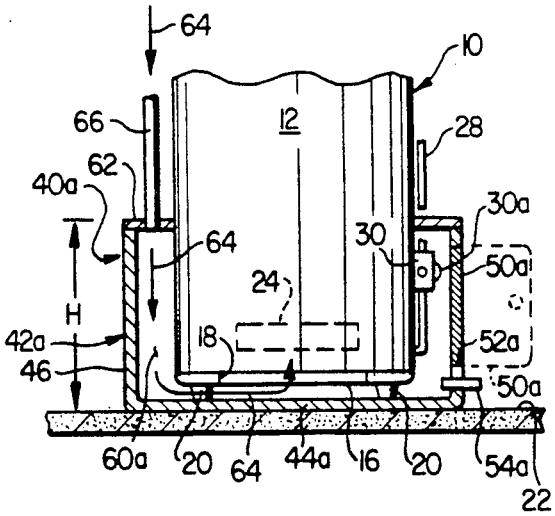
FIG. 2A is a view similar to that in FIG. 2 but illustrating an alternate embodiment of the combination drainage pan and combustion air flow control apparatus.

An alternate embodiment $40_a$ of the combination drainage catch pan and combustion air flow control structure 40 is illustrated in FIG. 2A. For ease in comparison, the components in the structure $40_a$ similar to those in structure 40 have been given identical reference numerals, but with the subscripts "a".

The structure $40_a$ is identical to the previously described structure 40 with the exception that the annular open top portion of the pan $42_a$ is closed off with a removable annular closure plate member. During water heater operation, combustion air 64 is flowed downwardly into the now enclosed annulus $60_a$ via an air inlet duct 66 connected at its open lower end to a suitable opening formed in the closure plate 62. The opposite end of the duct 64 may be suitably routed to a remote, even higher location (such as an outdoor air intake louver) for combustion air intake purposes.

The foregoing detailed description is to be clearly understood as being given by way of illustration and example only, the spirit and scope of the present invention being limited solely by the appended claims.

What is claimed is:

1. Fuel-fired water heater apparatus comprising:

a water heater body having a lower end with leg means thereon for supporting said body on a floor with said lower end spaced upwardly therefrom, said lower end having an air inlet formed therein;

a fuel burner supported by said body and positioned above said lower end, said fuel burner being operative to receive and combust a mixture of fuel from a source thereof and combustion air flowing through said air inlet, said fuel burner, when said water heater body is operatively supported on said floor, having a vertical height above said floor of less than 18";

combination drainage pan and combustion air flow control means for receiving and draining away water leaking from said water heater body, and for assuring that burner combustion air entering said air inlet is supplied thereto from a location substantially higher than burner height above the floor, said combination drainage pan and combustion air flow control means including a drain pan structure having:

a bottom wall positionable on the floor and upon which said leg means may be rested, a vertical side wall portion sized and configured to outwardly circumscribe a lower end portion of said water heater body with an upper end of said vertical side wall portion positioned substantially higher than the vertical height of said fuel burner and at least approximately 18" above said floor, and outlet means connected to a lower end section of said vertical side wall portion and operative to drain away water leaking from within and adjacent said water heater body and received in said drain pan structure.

2. The fuel-fired water heater apparatus of claim 1 wherein:

said drain pan structure has an open top end, and said vertical side wall portion is configured in a manner such that, when said lower end portion of said water heater body is operatively positioned within said drain pan structure, said vertical side wall portion defines a vertical combustion air flow passage disposed around said lower end portion of said water heater body and having an upwardly facing inlet opening positioned at least approximately 18" above the floor.

3. The fuel-fired water heater apparatus of claim 1 wherein:

said drain pan structure has a closed top end portion configured to extend around said water heater body, said vertical side wall portion is configured in a manner such that, when said lower end portion of said water heater body is operatively positioned within said drain pan structure, said vertical side wall portion defines a vertical combustion air flow passage disposed around said lower end portion of said water heater body, and said drain pan structure further includes an air inlet opening formed in an upper end portion thereof and connectable to air supply conduit means for supplying combustion air from a source thereof to the interior of said drain pan structure.

4. The fuel-fired water heater apparatus of claim 1 further comprising:

means, including valve means externally mounted on said water heater body, for receiving fuel from a source thereof and supplying the received fuel to said fuel burner, and access door means, associated with said vertical side wall portion of said drain pan structure, for selectively providing access to said valve means.

5. The fuel-fired water heater apparatus of claim 4 wherein:

said access door means are pivotable over an access opening formed in said vertical side wall portion of said pan structure between an open position and a closed position in which said access door means sealingly block said access opening.

6. Fuel-fired water heater apparatus comprising:

a water heater body having a lower end portion for supporting said body on a horizontal support surface, said lower end portion having an inlet formed therein;

a fuel burner carried by said body, above said air inlet, said fuel burner being operative to receive and combust a mixture of fuel from a source thereof and combustion air flowing upwardly through said air inlet;

said fuel burner, when said water heater body is operatively positioned on said horizontal support surface, being less than 18" above said support surface:

means, including valve means externally mounted on said water heater body, for receiving fuel from a source thereof and supplying the received fuel to said burner means;

combination drainage pan and combustion air flow control means for receiving and draining away water leaking from said water heater body, and for assuring that burner combustion air entering said air inlet is supplied thereto from a location at least approximately 18" above the floor, said combination drainage pan and combustion air flow control means including an open-topped drain pan structure having:

a bottom wall positionable on the floor and upon which said leg means may be rested, a vertical side wall portion sized and configured to outwardly circumscribe a lower end portion of said water heater body with an upper end of said vertical side wall portion at least approximately 18" above the floor, said vertical side wall portion being configured in a manner such that, when said lower end portion of said water heater body is operatively positioned within said drain pan structure, said vertical side wall portion defines a vertical combustion air flow passage outwardly circumscribing said lower end portion of said water heater body, and said valve means, and opening outwardly from said pan structure through its open upper end, and outlet means connected to a lower end section of said vertical side wall portion and operative to drain away water leaking from or adjacent said water heater body and received in said drain pan structure; and access door means, associated with said vertical side wall portion of said drain pan structure, for selectively providing access to said valve means.

7. The fuel-fired water heater apparatus of claim 6 wherein:

said access door means are pivotable over an access opening formed in said vertical side wall portion of said pan structure between an open position and a closed position in which said access door means sealingly block said access opening.

8. The fuel-fired water heater apparatus of claim 6 wherein:

said fuel-fired water heater apparatus is a gas fired water heater, and said valve means comprise a gas valve.

9. Fuel-fired water heater apparatus comprising:

a water heater body having a lower end portion for supporting said body on a horizontal support surface, said lower end portion having an air inlet formed therein;

a fuel burner carried by said body, above said air inlet, said fuel burner being operative to receive and combust a mixture of fuel from a source thereof and combustion air flowing upwardly through said air inlet, said fuel burner, when said water heater body is operatively positioned on said horizontal support surface, being substantially less than 18" above said horizontal support surface;

means, including valve means externally mounted on said water heater body, for receiving fuel from a source thereof and supplying the received fuel to said fuel burner;

combination drainage pan and combustion air flow control means for receiving and draining away water leaking from said water heater body, and for assuring that burner combustion air entering said air inlet is supplied thereto from a location at least approximately 18" above the floor, said combination drainage pan and combustion air flow control means including a drain pan structure having:

a bottom wall positionable on the floor and upon which said leg means may be rested, a vertical side wall portion sized and configured to outwardly circumscribe said valve means and a lower end portion of said water heater body, the upper end of said vertical side wall portion being at least approximately 18" above the floor, said vertical side wall portion being configured in a manner such that, when said lower end portion of said water heater body is operatively positioned within said drain pan structure, said vertical side wall portion defines a vertical combustion air flow passage outwardly circumscribing said lower end portion of said water heater body, a top end closure member configured to outwardly circumscribe said water heater body, and an air inlet formed in an upper end portion of said drain pan structure and connectable to air supply conduit means for supplying combustion air from a source thereof to the interior of said drain pan structure;

access door means, associated with said vertical side wall portion of said drain pan structure, for selectively providing access to said valve means; and outlet means connected to a lower end section of said vertical side wall portion and operative to drain away water leaking from and adjacent said water heater body and received in said drain pan structure.

10. The fuel-fired water heater apparatus of claim 9 wherein:

said access door means are pivotable over an access opening formed in said vertical side wall portion on said pan structure between an open position and a closed position in which said access door means sealingly block said access opening.

11. The fuel-fired water heater apparatus of claim 9 wherein:

said fuel-fired water heater apparatus is a gas fired water heater and said valve means comprise a gas valve.

12. For use with a fuel-fired water heater having a body with a lower end provided with leg means for supporting the body on a floor with the lower body end spaced upwardly from the floor; an air inlet formed in the lower body end; a fuel burner carried by the body above its lower end and operative to receive and combust a mixture of fuel from a source thereof and combustion air flowing upwardly through the air inlet; and means, including a fuel valve externally mounted on a side portion of the body, for receiving fuel from a source thereof and supplying the received fuel to the fuel burner, combination drainage pan and combustion air flow control apparatus for receiving and draining away water leaking from the water heater body, and for assuring that burner combustion air entering the body inlet opening is supplied thereto from a location at least 18" above the floor, said combination drainage pan and combustion air flow control means comprising a drain pan structure having:

a bottom wall positionable on the floor and upon which said leg means may be rested;

a vertical side wall portion sized and configured to outwardly circumscribe said valve means and a lower end portion of said water heater body with an upper end of said vertical side wall portion being at least 18" above the floor;

outlet means connected to a lower end section of said vertical side wall portion and operative to drain away water leaking from said water heater body and received in said drain pan structure; and access door means, associated with said vertical side wall portion of said drain pan structure, for selectively providing access to said valve means.

13. The apparatus of claim 12 wherein:

said drain pan structure has an open top.

14. The apparatus of claim 12 wherein:

said drain pan structure has a closed top end portion configured to outwardly circumscribe said water heater body, and said drain pan structure has an inlet opening formed in an upper end portion thereof and connectable to air supply conduit means for supplying combustion air from a source thereof to the interior of said drain pan structure.

15. The apparatus of claim 14 wherein:

said drain pan structure inlet opening is formed in said closed top end portion of said drain pan structure.

* * * * *

UNITED STATES PATENT AND TRADEMARK OFFICE

CERTIFICATE OF CORRECTION

PATENT NO. : 5,085,205

DATED : February 4, 1992

INVENTOR(S) : Jacob H. Hall and Timothy E. Powell

It is certified that error appears in the above-identified patent and that said Letters Patent is hereby corrected as shown below:

On the title page, item [54] title "FUEL-FIRED WATER HEATED" should be --FUEL-FIRED WATER HEATER--.

Signed and Sealed this

Twenty-fourth Day of August, 1993

Bruce Lehman

*Attest:*

BRUCE LEHMAN

*Attesting Officer*

*Commissioner of Patents and Trademarks*